United States Patent [19]

Suzuki et al.

[11] Patent Number: 4,946,350

[45] Date of Patent: Aug. 7, 1990

[54] CAPACITY CONTROL ARRANGEMENT FOR A VARIABLE CAPACITY WOBBLE PLATE TYPE COMPRESSOR

[75] Inventors: Shinichi Suzuki; Hiroshi Tanaka; Akira Nakamoto, all of Kariya, Japan

[73] Assignee: Kabushiki Kaisha Toyoda Jidoshokki Siesakusho, Aichi, Japan

[21] Appl. No.: 314,386

[22] Filed: Feb. 23, 1989

[30] Foreign Application Priority Data

Feb. 24, 1988 [JP] Japan ..... 63-41690

[51] Int. Cl.[5] ..... F04B 1/28

[52] U.S. Cl. ..... 417/222; 417/270

[58] Field of Search ..... 417/222, 222 S, 270

[56] References Cited

U.S. PATENT DOCUMENTS 4,841,736 6/1989 Suzuki ..... 417/222

4,862,700 7/1989 Suzuki ..... 417/222 S 4,880,356 11/1989 Suzuki et al. ..... 417/222 S

*Primary Examiner*—Leonard E. Smith

*Assistant Examiner*—John A. Savio, III

*Attorney, Agent, or Firm*—Burgess, Ryan and Wayne

[57] ABSTRACT

A capacity control arrangement controlling the capacity of a variable capacity wobble plate type compressor of a car air-conditioner driven by an engine of the car employs an engine load sensor, a compressor discharge pressure sensor, a car speed sensor, a compressor crankcase chamber pressure sensor, a miscellaneous air-conditioning data sensor, and a central processing unit to calculate and adjust a duty ratio value at which a solenoid-operated capacity control valve of the compressor is electrically driven. The adjustment of the duty ratio is carried out in such a manner when the engine load exceeds a predetermined value, the solenoid-operated capacity control valve first takes a fully open position to establish the lowest compressor capacity for an adjusted short period of time, and subsequently, takes a reduced opening position to maintain the lowest compressor capacity for as long as the engine load exceeds the predetermined value.

8 Claims, 5 Drawing Sheets

CAPACITY CONTROL ARRANGEMENT FOR A VARIABLE CAPACITY WOBBLE PLATE TYPE COMPRESSOR

BACKGROUND OF THE INVENTION

1. Field of the Invention

The present invention relates to a variable capacity wobble plate type compressor for a car air-conditioner, and more particularly, to a capacity control arrangement for controlling the discharge capacity of the variable capacity wobble plate type compressor.

2. Description of the Related Art

U.S. Pat. Nos. 4,730,986 and 4,747,754 disclose variable displacement or capacity wobble plate type compressors for a car air-conditioner provided with a capacity control unit employing a solenoid-operated valve to open and close a fluid passage communicating between a crankcase chamber for a wobble plate type rotation-to-reciprocation conversion mechanism and a discharge chamber for a high compressed refrigerant gas.

The conventional solenoid-operated valve of the variable capacity wobble plate type compressor is operated to fully open the fluid passage between the crankcase chamber and the discharge chamber, to thereby introduce a high pressure refrigerant gas from the discharge chamber into the crankcase chamber and apply a high back pressure to pistons when an engine load exceeds a predetermined level, for example, due to acceleration of the car. Upon application of the high back pressure to the pistons, a pulling force acts on a non-rotating wobble plate of the rotation-to-reciprocation conversion mechanism, connected to the pistons via piston rods, to reduce the inclination of the wobble plate with respect to a plane perpendicular to the axis of a drive shaft of the compressor, and as a result, the discharge capacity of the compressor is reduced to the lowest value.

In this conventional variable dispalcement wobble plate type compressor, the solenoid-operated valve remains fully open while the engine load is higher than a predetermined level, to maintain the compressor capacity at the lowest value, and thus the pressure within the crankcase chamber is maintained at a high level for a long period of time. As a result, a retainer ring for retaining the wobble plate on a rotatable drive plate keyed on the drive shaft, one end of each piston rod joined to the wobble plate by staking, the other end of each piston rod joined to the piston by staking, and other mechanical parts, must be exposed to an excessive mechanical load, which reduces the operational life of each of those parts.

To solve this problem, a copending U.S. patent application No. 07/306,342 of the same assignee as the present application (German Patent Application P 39033406) corresponding to Japanese Patent Application No. 63-26375 discloses a control circuit means for temporarily bringing the solenoid-operated valve of a variable capacity compressor, such as a variable capacity wobble plate type compressor, to a fully open condition, to thereby reduce the compressor capacity to a lowest value, and then reducing the opening of the solenoid-operated valve to an extent such that the lowest compressor capacity is maintained while the engine load is high. Nevertheless, in the control circuit means of the copending U.S. Patent Application, the temporary period of time for which the solenoid-operated valve is kept fully open is a fixed constant time, regardless of an extent of the cooling load of the car air-conditioner. Therefore, if the pressure in the crankcase chamber has been increased to a given high level according to a requirement for a cooling load reduction before the fully-open operation of the solenoid-operated valve is carried out, a state occurs wherein a high pressure level in the crankcase chamber is maintained for a time longer than the fixed constant period of time due to the fully opening of the solenoid-operated valve, and as a result, the parts of the compressor must be exposed to an excessive load in the same way as those of the conventional variable displacement wobble plate type compressors of U.S. Pat. Nos. 4,730,986 and 4,747,754.

According to the control circuit means of the copending U.S. patent application No. 07/306,342, an adverse state may also occur wherein the full opening of the solenoid valve for the fixed constant period of time is terminated before the compressor capacity is decreased to the lowest value, because the pressure in the crankcase chamber has been excessively lowered before the start of the full opening of the solenoid-operated valve. Consequently, the cooling ability of the car air-conditioner cannot be satisfactorily decreased even when the engine load is high, and therefore, the fuel consumption of the engine is increased.

SUMMARY OF THE INVENTION

Therefore, an object of the present invention is to obviate the drawbacks encountered by the control circuit means disclosed in the copending U.S. patent application No. 07/306,342.

Another object of the present invention is to provide a novel capacity control arrangement for a variable capacity wobble plate type compressor for a car air-conditioner provided with a solenoid-operated capacity control valve, whereby it is possible not only to realize the lowest compressor capacity operation of the compressor due to an increase in a pressure level in a crankcase chamber for a shortened period of time when an engine load exceeds a predetermined level, to thereby prolong the operational life of mechanical parts such as a wobble plate and piston rods, but also to reduce the compressor capacity to the lowest value when the engine is in an accelerating mode.

Therefore, in accordance with the present invention, there is provided a capacity control arrangement for a variable capacity wobble plate type compressor used for air-conditioning an engine driven car and provided with a drive shaft connectable to the car engine, a crankcase having a chamber for receiving an assembly of rotatable drive and non-rotatable wobble plates mounted on the drive shaft to cause a reciprocation of compressing pistons in response to the rotation of the drive shaft, a cylinder block having cylinder bores therein for the compressing pistons, a suction chamber for a refrigerant gas before compression, a discharge chamber for the compressed refrigerant gas, and a solenoid-operated valve for controlling a fluid communication between the crankcase and discharge chambers to thereby control a pressure level in the crankcase chamber in such a manner that an inclination of the wobble plate is changed to vary the capacity of the compressor. The capacity control arrangement comprises, in combination:

a first detecting means for detecting a pressure of the compressed gas discharged from the variable capacity wobble plate type compressor;

a second detecting means for detecting a load on the car engine;

a first control means connected to the first and second detecting means for controlling the operation of the solenoid-operated valve in such a manner that the solenoid-operated valve is in a fully open position establishing a complete fluid communication between the crankcase chamber and the discharge chamber, to thereby bring the inclination of the wobble plate to a position for the lowest capacity of the compressor by the introduction of the compressed gas of a high pressure from the discharge chamber to the crankcase chamber when the load on the car engine detected by the second detecting means exceeds a predetermined level;

a time setting means for setting a period of time for which the solenoid-operated valve is maintained at the fully open position in relation to the pressure of the compressed gas detected by the first detecting means; and a second control means also connected to the first and second detecting means for controlling the operation of the solenoid-operated valve in such a manner that the solenoid-operated valve is moved from the fully open position to a given reduced opening position suitable for maintaining the pressure in the crankcase chamber at a level capable of maintaining the lowest capacity of the compressor for a time interval from the termination of the period of time set by the time setting means to a detection of a reduction in the engine load below the predetermined level by the second detecting means.

The first detecting means may be arranged to detect a pressure level of the compressed gas within the discharge chamber of the variable capacity wobble plate type compressor.

BRIEF DISCRIPTION OF THE DRAWINGS

The above and other objects, features and advantages of the present invention will become more apparent from the ensuing description of the embodiment of the present invention taken in conjunction with the accompanying drawings wherein.

Figure 1:
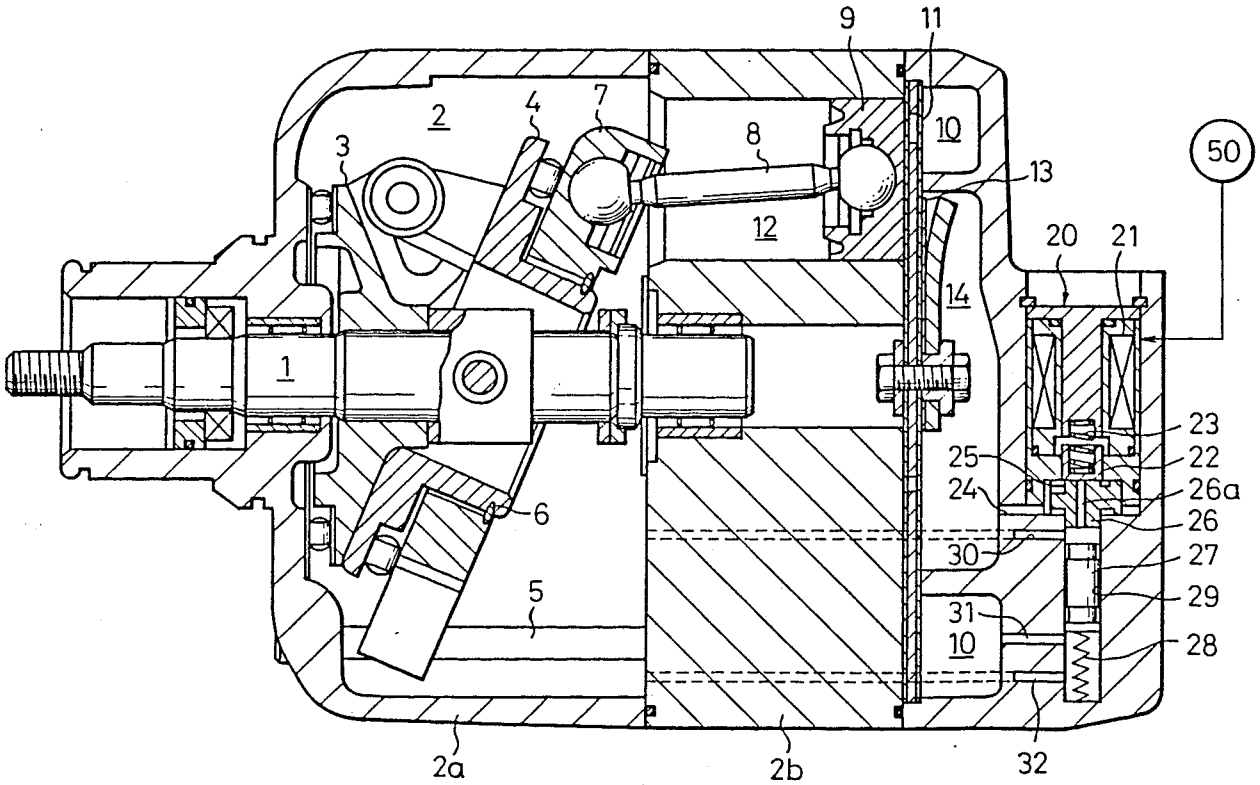
FIG. 1 is a longitudinal cross-sectional view of a variable capacity wobble plate type compressor with a solenoid-operated capacity control unit, to which a capacity control arrangement according to an embodiment of the present invention is applied.
Figure 4:
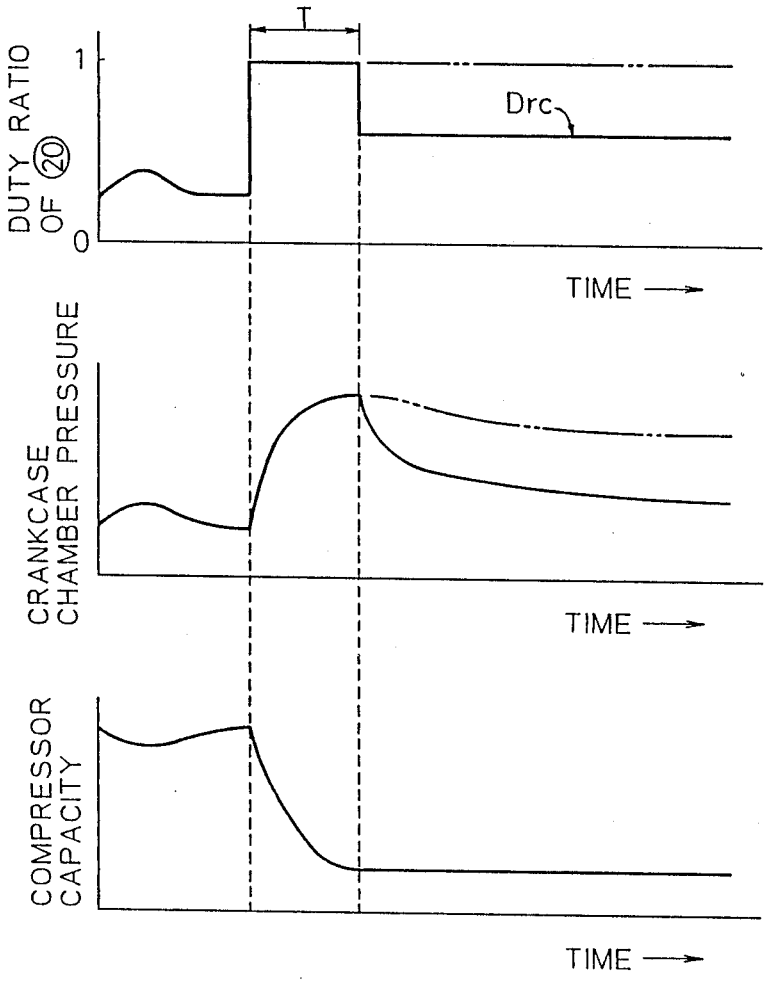
Figure 5:
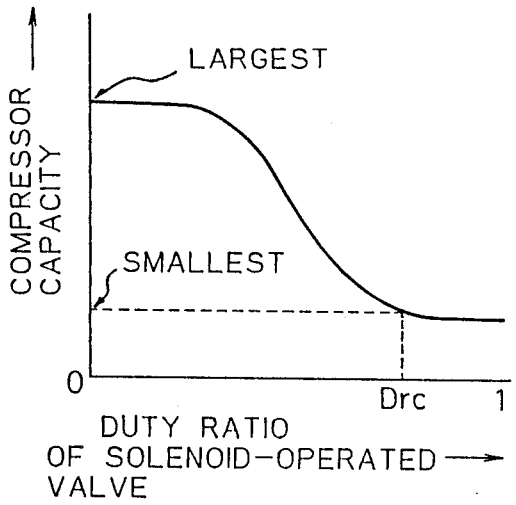

FIG. 4 is a graph illustrating respective modes of variation of the pressure in the crankcase chamber and the compressor capacity with time corresponding to the mode of variation of the duty ratio of the solenoid-operated valve during the operation of the variable capacity wobble plate type compressor of FIG. 1; and FIG. 5 is a graph illustrating a change of the capacity of the compressor as a function of the duty ratio of the solenoid-operated valve.

DESCRIPTION OF THE PREFERRED EMBODIMENTS

Referring to FIG. 1, a variable capacity wobble plate type compressor has a bell-jar-shape crankcase 2*a* sealingly connected to one end of a cylinder block 2*b* having a plurality of axial cylinder bores 12 angularly spaced apart from one another around the central axis thereof. The crankcase 2*a* and the cylinder block 2*b* centrally support a drive shaft 1 on which a drive element 3 and a rotary drive plate 4 are mounted for rotation together with the drive shaft 1 in the chamber 2 of the crankcase 2*a*. A non-rotatable wobble plate 7 mounted on the boss of the rotary drive plate 4 via a thrust needle bearing, is held in place by a retainer ring 6 and is restrained from rotation by an axis rod 5. The wobble plate 7 is connected, via connecting rods 8, to compressing pistons 9 reciprocatorily fitted in the cylinder bores 12 of the cylinder block 2*b*. When the drive shaft 1 is driven for rotation by a car engine together with the drive element 3 and the rotary drive plate 4, the wobble plate 7 is driven for a wobbling motion to cause a reciprocatory motion of the pistons 9 in the cylinder bores 12 via the connecting rods 8. As each piston 9 is reciprocated, a refrigerant gas is drawn through a suction chamber 10 for a refrigerant gas before compression and suction valves 11 into the cylinder bores 12, and the compressed refrigerant gas is discharged from the cylinder bores 12 through discharge valves 13 and a discharge chamber 14 for the compressed gas toward an external air-conditioning circuit.

When the pressure in the crankcase chamber 2 increased beyond the pressure in the suction chamber 10, a back pressure acting on rear faces of the pistons 9 increases to decrease the inclination angle of the wobble plate 7 with respect to a plane perpendicular to the axis of the drive shaft 1. Namely, the wobble plate 7 is moved to an erect position. As a result, the stroke of the pistons 9 is diminished to reduce the discharge capacity of the wobble plate type compressor.

Conversely, when the pressure in the crankcase chamber 2 decreases, the inclination angle of the wobble plate 7 is increased to increase the stroke of the pistons 9, and the capacity of the wobble plate type compressor is in turn increased.

A solenoid-operated valve 20 is provided in a rear housing, i.e., the right-hand end member as viewed in FIG. 1 of the crankcase 2*a*, to carry out a capacity control operation. The solenoid-operated valve 20 comprises a solenoid 21 energized by supply of an electric drive signal from outside the compressor, an axially movable plunger 22, a spring 23 biasing the plunger 22 away from the solenoid 21, a fixed valve seat 26 having a central valve bore 26*a*, a spool 27 fitted in a spool bore 29, and a spring 28 biasing the spool 27 toward the plunger 22. When the solenoid 21 is energized, the plunger 22 is electro-magnetically moved upward against the spring force of the spring 23, the compressed refrigerant gas having a high discharge pressure is allowed to flow from the discharge chamber 14 though passages 24 and 25 and the valve bore 26 to apply the discharge pressure to the upper end of the spool 27, so that the spool 27 is moved downward against the spring force of the spring 28 to allow the compressed refrigerant to flow through the spool bore 29 and a passage 30 into the crankcase chamber 2, and at the same time, the spool 27 closes passages 31 and 32 to increase the pressure in the crankcase chamber 2. When the solenoid 21 is de-energized, the plunger 22 is moved downward by the spring 23 to disconnect the discharge chamber 14 from the crankcase chamber 2, whereby the spool 27 is moved upward by the spring 28 to open the passages 31 and 32, so that the crankcase chamber 2 is communicated with the suction chamber 10. Then, the refrigerant gas is evacuated from the crankcase chamber 2 toward the suction chamber 10 to reduce the pressure level in the crankcase chamber 2.

Figure 2:
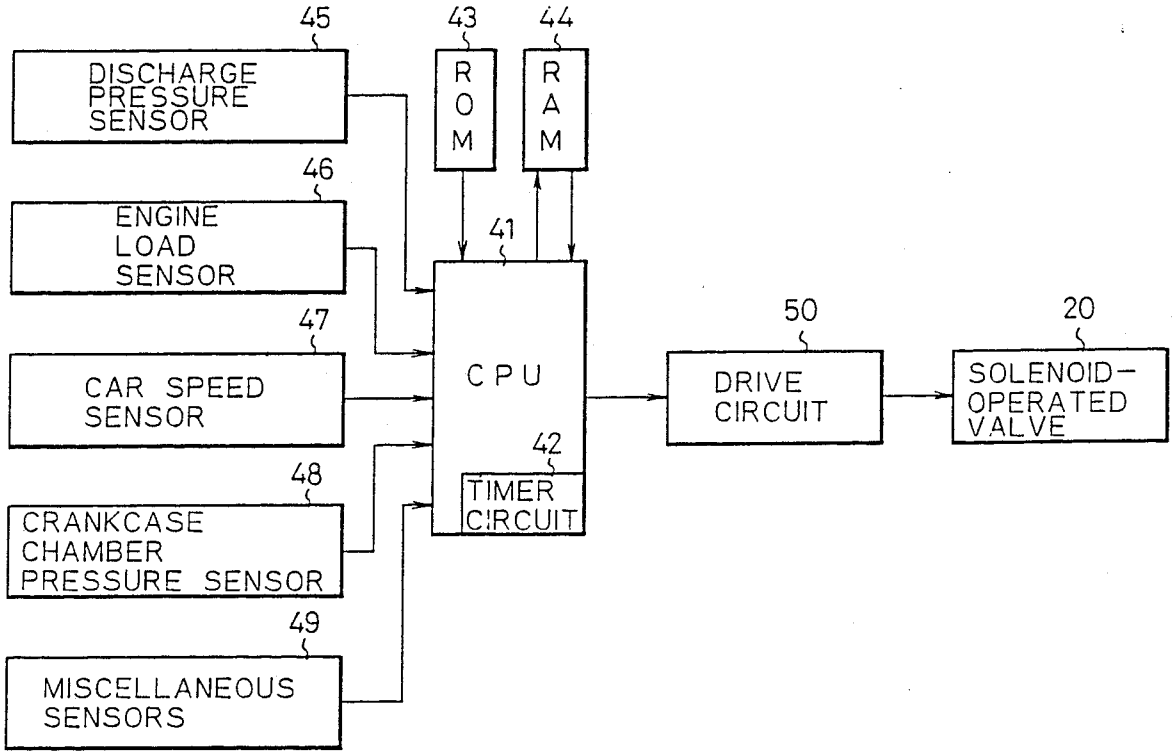
FIG. 2 is a block diagram of the capacity control arrangement for the variable capacity wobble plate type compressor of FIG. 1.

A capacity control arrangement for the variable displacement wobble plate type compressor thus constructed will be described hereinafter with reference to FIG. 2.

A central processing unit (hereinafter abbreviated to "CPU") 41, i.e., first and second control means, includes a timer circuit 42 used for a time setting. A read only memory (ROM) 43 storing operation programs, such as a later-described control program illustrated in FIG. 3, to be implemented by the CPU 41, and a random access memory (RAM) 44 for temporarily storing the results of the implemented operation, are connected to the CPU 41.

A discharge pressure sensor (first detecting means) 45 for detecting a pressure of the compressed refrigerant gas discharged from the compressor, an engine load sensor (second detecting means) 46 for detecting load on the car engine, a car speed sensor 47 for detecting a car speed, a crankcase chamber pressure sensor 48 for detecting the pressure level in the crankcase chamber 2, and other miscellaneous sensors 49, are connected to the CPU 41.

The discharge pressure sensor 45 is disposed within the discharge chamber 14 of the compressor to detect the discharge pressure and sends a detection signal to the CPU 41, indicating the pressure level in the discharge chamber 14. The engine load sensor 46 may be a conventional potentiometer connected to the accelerator pedal of the car to detect the position of the accelerator pedal and output a signal indicating an actual load on the car engine. The car speed sensor 47 is a rotary encoder associated with the driving axle of the car drive wheels to detect the rotating speed of the driving axle and outputting a corresponding signal. The signals output from the engine load sensor 46 and the car speed sensor 47 are sent to the CPU 41. The crankcase chamber pressure sensor 48 is disposed within the crankcase chamber 2 of the compressor. The miscellaneous sensors 49 are, for example, a car cabin temperature sensor, an external temperature sensor, a heat exchange rate sensor, and the like.

The CPU 41 detects a cooling load on the basis of data input thereto by the dischargepressure sensor 45, the crankcase chamber pressure sensor 48, and the miscellaneous sensors 49. Then, the CPU 41 controls a drive circuit 50 to electrically drive the solenoid-operated valve 20 at an appropriate duty ratio. It should be understood that, when the solenoid-operated valve 20 is driven by the drive circuit 50 at a duty ratio of "1", the fluid passages connecting the crankcase chamber 2 and the discharge chamber 14 are brought to a fully open state.

Figure 3:
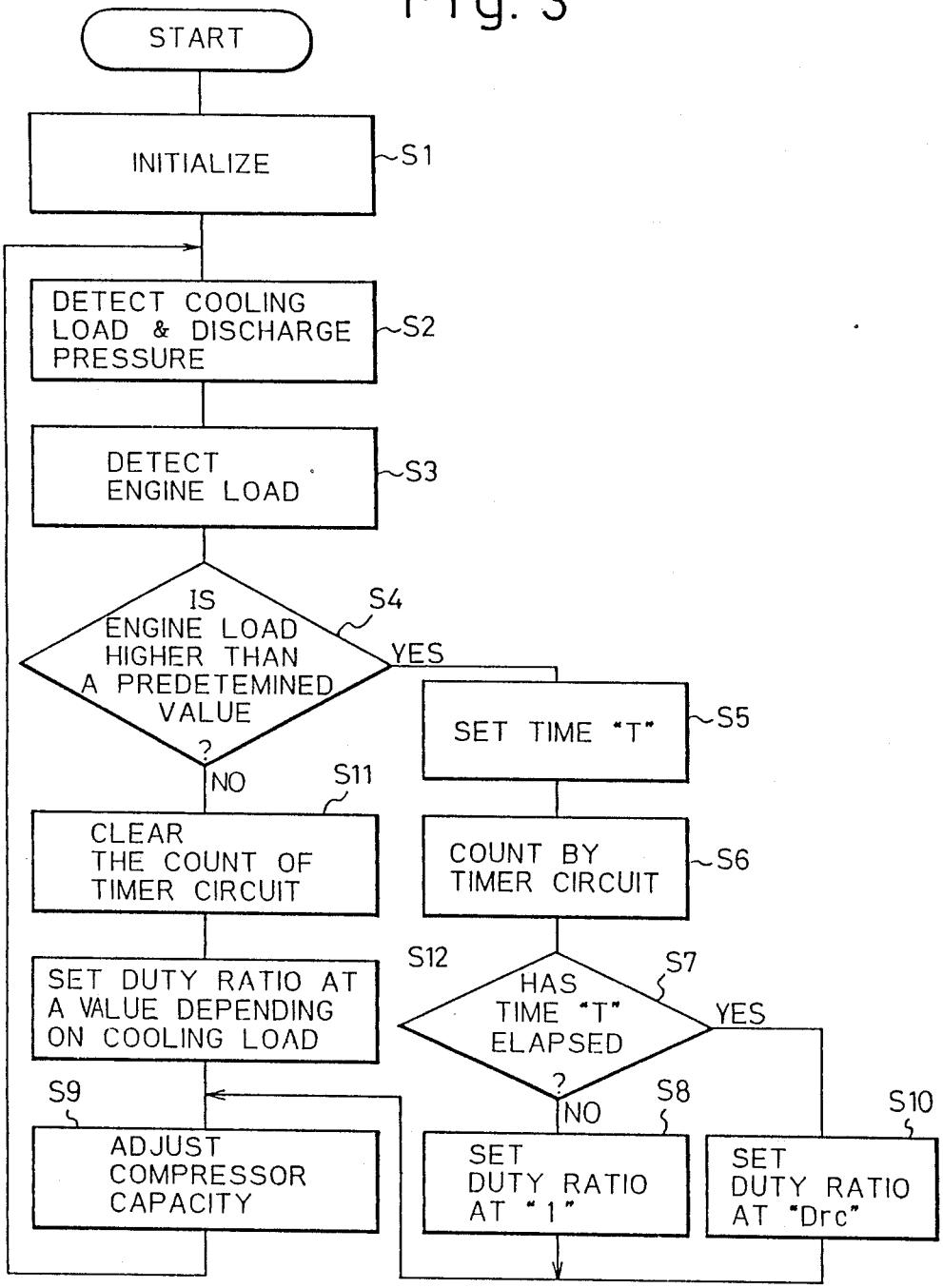
FIG. 3 is a flow chart of assistance in explaining the operation of the capacity control arrangement of FIG. 2.

When the start switch of the air-conditioner is turned ON, the CPU 41 implements the control program illustrated in FIG. 3. In step 1 (S1), the RAM 44 is initialized. In step 2 (S2), the discharge pressure sensor 45 detects the discharge pressure level, and the CPU 41 detects the cooling load on the basis of data input thereto by the crankcase chamber pressure sensor 48 and the miscellaneous sensors 49. In step 3 (S3), the CPU 41 detects the engine load on the basis of data input thereto by the engine load sensor 46. In step 4 (S4), the CPU 41 determines whether or not the engine load detected by the engine load sensor 46 is higher than a predetermined value. When the decision in step 4 is affirmative (YES), namely, when the load on the car engine is increased beyond the predetermined value, due to the car being in an accelerating running mode or a hill-climbing mode, the control program goes to step 5 (S5), where the timer circuit 42 sets a time T for which the solenoid-operated valve 20 is to be continuously energized under the duty ratio "1" (FIG. 4); namely, a time period T for which the full open condition of the passage between the crankcase chamber 2 and the discharge chamber 14 is maintained is set by the timer circuit 42. At this stage, it should be understood that the above-mentioned set time T is comparatively long when the discharge pressure of the compressor is low, since a comparatively long time is necessary for decreasing the compressor capacity to the lowest value by increasing the pressure level in the crankcase chamber 2. On the other hand, the set time T is comparatively short when the discharge pressure of the compressor is high, since the compressor capacity can be reduced to the lowest value in a comparatively short time by the high discharge pressure. In step 6 (S6), the timer circuit 42 counts the time T; i.e., the fully open time of the solenoid-operated valve 20. In step 7 (S7), it is determined by the CPU 41 whether or not the period of time limited by the set time T has elapsed. When the decision in step 7 is negative, the control program goes to step 8 (S8) to maintain the duty ratio of the solenoid valve 20 at "1" until the period of time limited by the set time T has elapsed, and then the solenoid valve 20 is driven under the duty ratio "1" in step 9 to increase the pressure in the crankcasechamber 2 so that the capacity of the compressor is rapidly decreased to the lowest value.

When the decision in step 7 is affirmative, the duty ratio is changed to a low value $D_{rc}$ (0.4 in the embodiment) suitable for keeping the compressor capacity at the lowest value, and then the solenoid-operated valve 20 is driven at the duty factor $D_{rc}$ in step 9 to keep the capacity of the compressor at the lowest value.

When the decision in step 4 is negative (NO), i.e., when the load on the car engine is lower than the predetermined value, the count of the timer circuit 42 is cleared in step 11 (S11), and a duty ratio corresponding to the cooling load is set in step 12 (S12) according to the result of the detection in step (S2). Then, the solenoid-operated valve 20 is driven in step 9 (S9) at the duty ratio set in step 12 to increase the capacity of the compressor.

As is obvious from FIG. 4, when a detection of the increase of the engine load beyond the predetermined value is made while the compressor is operating, the solenoid-operated valve 20 is first driven at a duty ratio "1" for the set time T depending on the discharge pressure level to rapidly reduce the capacity to the lowest value by increasing the pressure level in the crankcase chamber 2. Subsequently, the solenoid-operated valve 20 is switched to a state wherein the valve 20 is driven at the low duty ratio $D_{rc}$ after the capacity has been reduced to the lowest value to reduce the pressure level in the crankcase chamber 2 while keeping the lowest capacity. Accordingly, as indicated by alternate long and two short dash lines in FIG. 4, the pressure in the crankcase chamber 2 is reduced to a low level during a time in which the compressor capacity is kept at the lowest value whereas, according to the prior art, the solenoid-operated valve 20 is continuously driven at a duty ratio "1", and thus the pressure level in the crankcase chamber 2 must be maintained for a long time at a high level. Therefore, according to the present invention, a mechanical load on the wobble plate 7 and the internal mechanism including the piston rods 8 is decreased, and thus the operational life of the wobble plate 7 and the internal mechanisms can be prolonged. Furthermore, as is obvious from FIG. 5, since the solenoid-operated valve 20 is driven at a predetermined duty ratio $D_{rc}$, which is smaller than "1", to keep the capacity at the lowest value, the change of the duty ratio of the solenoid-operated valve 20 to increase the compressor capacity from the lowest value to the highest value can be achieved at a high response speed.

Moreover, since determination of the period of time for which the solenoid-operated valve 20 is continuously driven at the duty factor "1" to reduce the capacity to the lowest value is implemented by the CPU 41 in response to a detection of the discharge pressure of the compressor, the solenoid-operated valve 20 is not continuously driven at the duty ratio "1" regardless of a supply of a sufficient amount of the compressed refrigerant gas to the crankcase chamber 2, and accordingly, the afore-described adverse effect of the high pressure in the crankcase chamber 2 on the elements and parts of the compressor is obviated.

Moreover, the capacity control arrangement according to the present invention is able to prevent an increase in the fuel consumption. Namely, since the length of time for which the solenoid valve 20 is driven at the duty ratio "1" is appropriately controlled, taking into account the engine load, the compressor is not operated at a high capacity regardless of a high engine load of the car, and accordingly, an increase in the fuel consumption can be prevented. For example, even when a supply of the compressed refrigerant gas from the discharge chamber 14 to the crankcase chamber 2 is not sufficient to increase the pressure in the crankcase chamber 2 to a high level, and when the compressor capacity must be reduced to the lowest value according to an engine load requirement, the period of time T for which the solenoid-operated valve 20 is maintained at a fully open condition is relatively long under the control of the capacity control arrangement of the present invention, and thus the pressure level in the crankcase chamber 2 can be eventually increased to a high pressure level sufficient to reduce the compressor capacity to the lowest value. Accordingly, the above-mentioned problem of a high fuel consumption can be avoided, and the compressor capacity can be controlled safely and efficiently according to the load on the car engine.

In the foregoing embodiment, the discharge pressure sensor 45, i.e., the first detecting means, detects the discharge pressure of the compressed refrigerant varying according to the variation of the cooling load, and the duration of operation of the solenoid-operated valve 20 at the duty ratio "1" is determined according to the discharge pressure detected by the discharge pressure sensor 45, namely, a period in which the solenoid-operated valve 20 is fully opened is determined directly depending on the pressure level in the crankcase chamber 2.

Accordingly, the reduction of the pressure in the crankcase chamber 2, and thus the reduction of the capacity of the variable capacity wobble plate type compressor to the lowest value, can be accomplished in the shortest possible time.

Application of the present invention is not limited to the foregoing embodiment. For example, the time T limiting a duration during which the solenoid-operated valve 20 is driven at the duty factor "1" may be determined on the basis of data supplied from the crankcase chamber pressure sensor 48. In such a case, the crankcase chamber pressure sensor 48 functions as the first detecting means, and the time T limiting a duration during which the solenoid-operated valve 20 is driven at the duty ratio "1" is determined according to the pressure in the crankcase chamber 2, which itself is a controlled variable.

Moreover, the data for determining the time T limiting a duration during which the solenoid-operated valve 20 is driven at the duty ratio "1" may include the difference between the pressure in the crankcase chamber 2 and the pressure in the suction chamber 10, and the heat exchange rate, in addition to the data obtained by the discharge pressure sensor 45 or the crankcase chamber pressure sensor 48, or may be data obtained by both the discharge pressure sensor 45 and the crankcase chamber pressure sensor 48. It is also possible to construct the solenoid-operated valve 20 so that the discharge pressure is applied to the crankcase chamber 2 when the solenoid 21 of the solenoid-operated valve 20 is de-energized. As is apparent from the foregoing description, according to the present invention, the pressure in the crankcase chamber is increased for less time. When reducing the capacity of the compressor to the lowest value if the engine load is higher than a predetermined level. Therefore, a mechanical load on the wobble plate and the internal mechanisms of the wobble plate type compressor including the piston rods can be reduced, to lengthen the operational life thereof. In addition, the capacity of the compressor can be changed at a high response speed, and the capacity of the compressor can be reduced to the lowest value when the engine load exceeds a predetermined level.

The foregoing description of the preferred embodiments is given only for the purpose of illustrating the present invention, and many further modifications and variations may occur to a person skilled in the art without departing from the scope of claims.

We claim:

1. A capacity control arrangement for a variable capacity wobble plate type compressor used for air-conditioning an engine driven car and provided with a drive shaft connectable to the car engine, a crankcase having a chamber for receiving an assembly of rotatable drive and non-rotatable wobble plates mounted on the drive shaft to cause a reciprocation of compressing pistons in response to the rotation of the drive shaft, a cylinder block having cylinder bores therein for the compressing pistons, a suction chamber for a refrigerant gas before compression, a discharge chamber for the compressed refrigerant gas, and a solenoid-operated valve for controlling a fluid communication between the crankcase and discharge chambers to thereby control a pressure level in the crankcase chamber in such a manner that an inclination of the wobble plate is changed to vary the capacity of the compressor, comprising, in combination:

a first detecting means for detecting a pressure of the compressed gas discharged from said variable capacity wobble plate type compressor;

a second detecting means for detecting a load on said car engine;

a first control means connected to said first and second detecting means for controlling the operation of said solenoid-operated valve in such a manner that said solenoid-operated valve takes a fully open position to establish a complete fluid communication between said crankcase chamber and said discharge chamber to thereby bring the inclination of said wobble plate to a position for a lowest capacity of said compressor by the introduction of the compressed gas of a high pressure from said discharge chamber to said crankcase chamber when the load on said car engine detected by said second detecting means exceeds a predetermined level;

a time setting means for setting a time for which said solenoid-operated valve is maintained at the fully open position in relation to the pressure of the compressed gas detected by said first detecting means; and a second control means also connected to said first and second detecting means for controlling the operation of said solenoid-operated valve in such a manner that said solenoid-operated valve is moved from the fully open position to a given reduced opening position suitable for maintaining the pressure in said crankcase chamber at a level capable of maintaining the lowest capacity of said compressor for a time from the elapse of the time set by said time setting means to a detection of a reduction in the engine load below the predetermined level by said second detecting means.

2. A capacity control arrangement for a variable capacity wobble plate type compressor according to claim 1, wherein said first detecting means is arranged in said discharge chamber to detect a pressure of said compressed refrigerant gas in said discharge chamber.

3. A capacity control arrangement for a variable capacity wobble plate type compressor according to claim 1, wherein said first detecting means comprises a pressure detecting means arranged in said chamber of said crankcase for detecting a pressure level in said crankcase chamber.

4. A capacity control arrangement for a variable capacity wobble plate type compressor according to claim 1, wherein said arrangement further comprises a central processing unit (a CPU) including said first and second control means and said time setting means, said CPU being connected to said first and second detecting means.

5. A capacity control arrangement for a variable capacity wobble plate type compressor according to claim 4, further comprising an electric drive circuit means connected to said solenoid-operated valve for energizing said solenoid-operated valve, said electric drive circuit means being also connected to said CPU for receiving an electric drive signal including a value of a duty ratio at which said solenoid-operated valve is energized.

6. A capacity control arrangement for a variable capacity wobble plate type compressor according to claim 5, further comprising a third detecting means for detecting a car speed, a fourth detecting means for detecting a pressure level in said crankcase chamber, a fifth detecting means for detecting miscellaneous air-conditioning data, said third through fifth detecting means being connected to said CPU to supply said CPU with detected results on the basis of which said CPU calculates a cooling load applied to said compressor and said value of the duty ratio.

7. A capacity control arrangement for a variable capacity wobble plate type compressor according to claim 5, wherein said time setting means of said CPU sets said value of the duty ratio.

8. A capacity control arrangement for a variable capacity wobble plate type compressor according to claim 7, wherein when said value of the duty ratio set by said time setting means is 1, said solenoid-operated valve takes said fully open position to establish a complete fluid communication between said crankcase chamber and said discharge chamber.

* * * * *